United States Patent [19]

Mitchell

[11] Patent Number: 4,544,134

[45] Date of Patent: Oct. 1, 1985

[54] TOOL FOR TORSION BAR REMOVAL

[76] Inventor: Thomas Mitchell, 6480 Winevillea Ave., Mira Loma, Calif. 91752

[21] Appl. No.: 555,193

[22] Filed: Nov. 25, 1983

[51] Int. Cl.[4] ..... B66F 3/24

[52] U.S. Cl. ..... 254/93 R; 254/133 R; 280/754; 29/252; 29/426.5

[58] Field of Search ..... 254/133, 93 H, 118, 254/93 R; 29/426.5, 252, 282, 273; 280/704, 754

[56] References Cited

U.S. PATENT DOCUMENTS

| | | | |
|---|---|---|---|
| 987,532 | 3/1911 | Willour | 254/118 |
| 1,093,863 | 4/1914 | Kugler | 254/118 |
| 2,666,619 | 1/1954 | Bloom | 280/754 X |
| 2,789,342 | 4/1957 | Pouell | 29/252 |
| 3,780,988 | 12/1973 | Castoe | 254/133 X |
| 3,891,187 | 6/1975 | Bearden, Jr. | 254/93 R |

*Primary Examiner*—Howard N. Goldberg
*Assistant Examiner*—J. Burtch
*Attorney, Agent, or Firm*—Harvey S. Hertz

[57] ABSTRACT

A tool particularly useful for facilitating the removal of a torsion bar employed as a spring element, particularly in automobiles such as the familiar Volkswagon rear-engine models. The torsion bar exerts a normal torque holding a spline-connected cantilever bar against a stop integral with a fixed structural member. The tool engages the arm adjacent its cantilevered end and applies a force increasing the torsion bar reaction force sufficient to dislodge it from the stop so that the cantilever bar can be forced outwardly by separate means to disengage the torsion bar-to-cantilever arm spline connection by a sufficient amount to allow controlled de-torquing rotation of the arm without encountering the stop. The spline connection may be subsequently fully disengaged and the torsion bar removed from its internal structural anchor. The tool includes an elongated closed frame forming an internal pocket within one end, a jack situated within the internal pocket and engagement hardware at the other end of the frame for connecting to a structural member of the vehicle.

7 Claims, 3 Drawing Figures

TOOL FOR TORSION BAR REMOVAL

BACKGROUND OF THE INVENTION (1) Field of the Invention

The invention relates to automotive repair and maintenance methods and tools generally and more specifically to a torsion bar removal method and tool.

(2) Description of the Prior Art

In the prior art, the removal of a torsion bar from the rear suspension structure of a rear-engine Volkswagon automobile has been a laborious and time consuming endeavor. This is because, at rest, the torsion bar is "loaded" to produce a reaction torque forcing a cantilever arm secured to the outward end of the torsion bar into rotational engagement with a structurally integral stop adjacent the arm's cantileveled end. Normally, this cantilevered end holds the bearing which supports a wheel spindle. The axle in turn engages an axle from the transmission/differential case through universal joints so that springing action is provided responsive to vehicle load conditions and the vertical component of road shock (from bumps, chuck holes, etc.).

The removal of a torsion bar in an arrangement of the aforementioned character previously has involved apparatus working with respect to the ground or with prying means for lifting the end of the cantilevered arm from the stop. The subsequent partial removal of the spline engagement of the arm, at the outward torsion bar extremity is then difficult and must be accomplished while the pry or ground based jacking force is maintained. More than one person is required for such a procedure.

Apparatus is known for effecting the removal of various automotive component parts, such as king pins, bushings, bearings and the like. For example, U.S. Pat. No. 2,789,342 entitled "Spring Tool" discloses apparatus to lift an end of a loaded coil compression spring (in an automobile) from its bearing plate to facilitate the installation of shims to level the vehicle in its quiescent condition. A hydraulic jack forms a part of the apparatus, which will be seen to be quite different in construction and purpose vis-a-vis the present invention.

In the automotive environment, the apparatus of U.S. Pat. No. 3,217,394 provides a hydraulic portable device for in situ installation or removal of press-fitted bushings or the like. The in situ removal and reset of bushings in the automotive environment is also the subject of U.S. Pat. No. 2,859,456. In that disclosure a screw operated device is provided for in situ removal or reset of the same type of bushing.

Still another bearing/bushing removal device is shown in U.S. Pat. No. 3,103,064. However, that device differs from the aforementioned devices in that an axle assembly or the like must be removed from the vehicle and mounted in the stand according to that disclosure.

In U.S. Pat. No. 1,899,351, a closed "A" frame tool includes an internal hydraulic jack particularly designed for removal of so-called king pins from the steering and support front wheel structure of an automobile. The concept of gripping the structural part, in which the king pin resides, from both ends of the king pin prevents the applied hydraulic removal force from being applied to other parts of the automobile mechanisms, thereby avoiding damage thereto.

None of the aforementioned prior art devices is adapted to the particular use intended for the present invention and none anticipates the problem giving rise to the invention.

The manner in which the invention fills the particular need for which it was developed will be evident as this description proceeds.

SUMMARY OF THE INVENTION

The invention may be broadly summarized as a method and apparatus for dismounting the torsion bar assembly in an automotive arrangement as described in the foregoing. The arm (spring plate as it is sometimes called), which is spline mounted on one end of the torsion bar, supports the rear wheel and brake assembly at its cantilevered end, the torsion bar providing the spring action resisting the vertical forces extant at the said wheel. In the unloaded vehicle condition, the spring plate arm tend to rotate against a stop which is part of or is attached to the automobile frame structure. This stop engagement is interrupted if the vehicle is excessively loaded, the torsion bar being subjected to increased torque load in that condition.

The invention includes the method of artificially torquing the aforementioned arm with respect to the fixed automotive structure to allow its position at the torsion bar spline connection to be shifted outward (axially with respect to the torsion bar), by an amount sufficient to permit the arm to clear the stop when the artificial torque is gradually released. Subsequently, the torsion bar is in the unloaded condition and the arm can be removed completely without encountering any torque reaction. Similarly, the torsion bar can be easily pulled free of its inner spline engagement with the automotive structure.

The apparatus for accomplishing the foregoing includes a closed "A" frame for bolting through a mounting hole in a structural member of the vehicle above the arm. Inside the base of the "A" frame, a jack is placed which provides the artificial torquing of the arm. An upwardly open, U-shaped piece at the jack piston end fits under the arm at a point between the spline connection and the arm at a point between the spline connection and the arm cantilevered end (where the wheel, brake and associated parts are normally mounted). Of course, the wheel and its associated parts will have been previously removed. The details of a typical embodiment according to the invention will be evident as this description proceeds.

DETAILED DESCRIPTION

Figure 1:
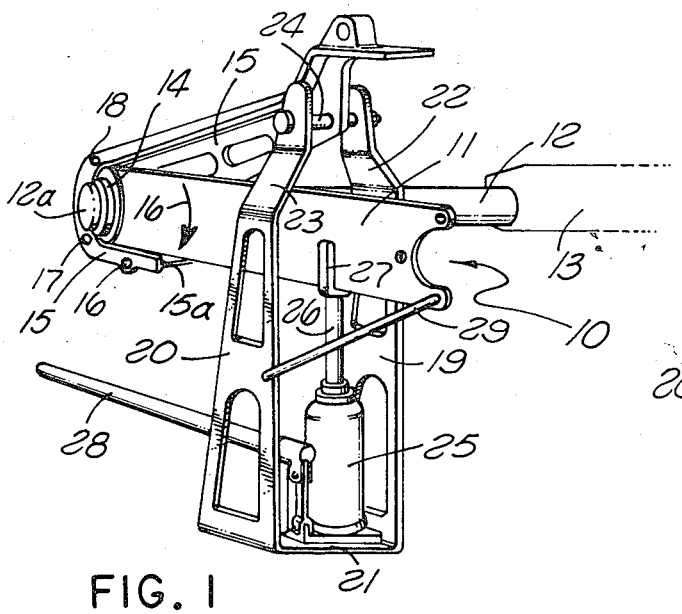
FIG. 1 is a pictorial view of the apparatus of the invention applied to the partially disassembled automobile rear wheel support structure.
Figure 2:
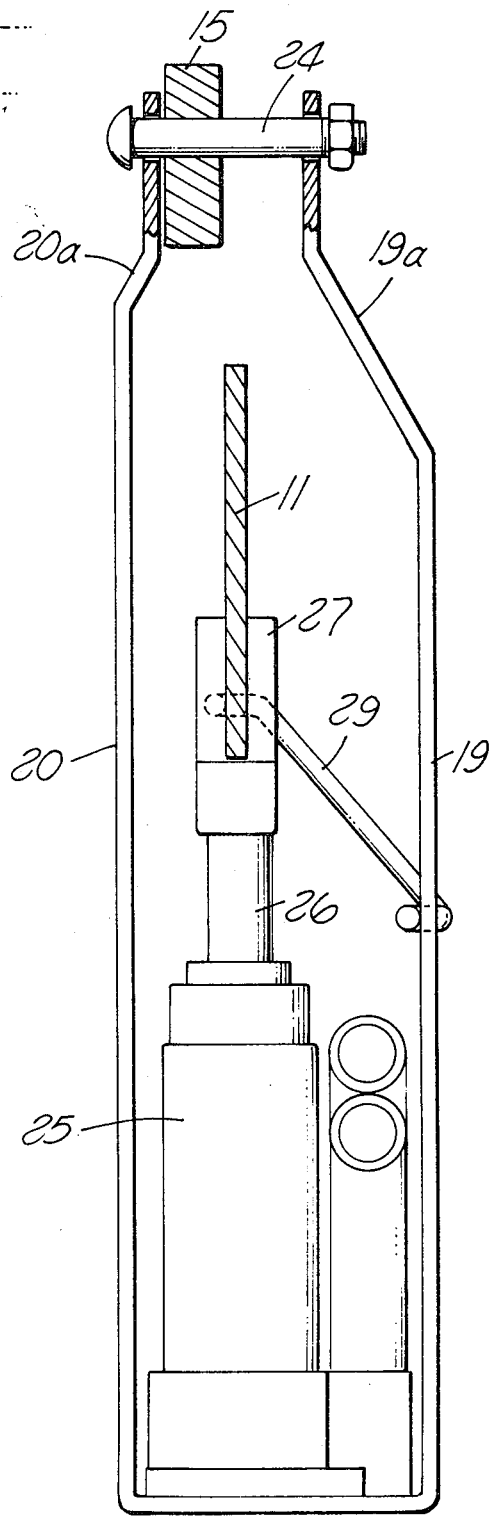
FIG. 2 is a right end view of FIG. 1.

Referring to FIG. 1, a portion of the typical rear wheel support structure of the well-known, rear-engine, Volkswagon automobile is depicted. The wheel, brake, and associated parts are normally mounted at 10, which is the cantilevered end of the arm (spring plate) 11. The torsion bar 12 is rotationally anchored to the structure within 13 at one (fixed) end and is spline mated at its outward end 12*a* to an internally mating surface in a bushing 14, which is an integral part of arm 11 at that location.

A structural part 15 serves as a support for the torsion bar and arm 11 as shown. The normal torsional force of the torsion bar 12 is such as to tend to rotate the arm 11 about 12*a* in the direction of the arrow 16. The normal rest position (no load or weight in the vehicle) of arm 11 is against the structure 15 acting as a stop 15*a*. At the point 15*a*, an upward lip on 15 is provided and the arm normally rests inside this lip. A cap (not shown) bolted on via bolt holes 16, 17 and 18 further serves to constrain the torsion bar end 12*a* in the axial (longitudinal) direction of the torsion bar.

It will be seen that, the spring torque provided by the torsion bar 12 is a major problem in its removal. Prior methods involving jacking of the arm against a floor surface are dangerous and unsatisfactory in that some weighting of the vehicle or similar measure is necessary if the arm is to be deflected against the increased torsion bar torque thereby produced, without causing an unstable condition.

In accordance with the invention, the arm deflecting torque is applied with respect to the vehicle structure adjacent to the arm and there is accordingly no effect on the positional stability of the vehicle and no hazard in respect to any jack or support used to support the vehicle with a wheel removed.

The apparatus of the invention includes an A-frame typically having sides 19 and 20, a jack 25 held by the A-frame base 21 and its operating handle 28. A U-shaped clip 27 is mounted on top of the jack shaft 26 so that the arm 11 is unlikely to slip free of the jack. The jack is preferably of the hydraulic type. However, a pneumatic or purely mechanical type of jack could be employed as an alternative.

After the arm 11 is forced upward by jack 25 against the torsion bar resistance, it can obviously be removed (outwardly) from the spline engagement at 12*a* by an amount sufficient to clear the lip of the stop at 15*a*. The jack 25 may then be lowered to a position bringing 10 downward vis-a-vis the position illustrated in FIG. 1.

Figure 3:
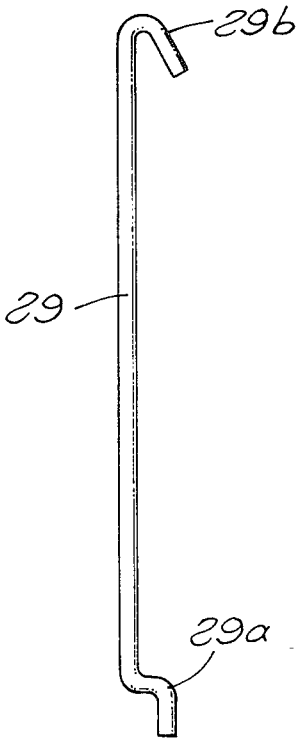
FIG. 3 is a safety bar as seen in FIG. 1.

The safety clip 29 prevents unwanted reactionary movements of the A-frame and jack assembly during operation. The clip 29 may be either from A-frame side 20 to a mounting bolt hole in arm 11 as shown in FIG. 1, or from A-frame member 19 to the same bolt hole in arm 11 as shown in FIG. 3. The actual shape of the A-frame converging portions 19*a* and 20*a* is somewhat arbitrary, however, the general purpose is to provide approximate force vector alignment of the jack piston 26 with the center of bolt 24 so that the tendency of A-frame to tilt during jacking will be minimized.

The safety clip is shown independently in FIG. 3 to illustrate its preferred shape. The clip end configuration at 29*a* is inserted into the arm 11 and the end 29*b* engages the A-frame 20 as indicated.

Variation in the specific structures shown and described are possible once the principles of the invention are understood. Accordingly, it is not intended that the scope of the invention should be considered limited to the drawings or this description, these being typical and illustrative only.

I claim:

1. Apparatus for removing a torsion bar from a rear engine Volkswagon vehicle said torsion bar being inwardly anchored by a spline connection to the structure of said vehicle, comprising:

an A-frame having a substantially horizontal base plate from which two attached upwardly convernning legs extend to form an apex;

means for attaching said converging legs adjacent said apex to a fixed structural member of said vehicle above the cantilevered arm which normally couples the outer end of said torsion bar to a wheel assembly of said vehicle, said arm resting on a stop integral with said vehicle structure and projecting between said A-frame legs;

means for applying a compressive force between said base plate and the lower edge of said arm and thereby applying a compressive force between said apex and said arm to rotate said arm upward by a predetermined amount without applying a net lifting force to said vehicle such that a separate outward force can be applied to partially outwardly disengage said torsion bar axially such that subsequent release of said compressive force permits said arm to rotate downward, without engaging said stop, to a position in which said torsion bar is substantially unloaded permitting the complete removal of said torsion bar from its inward spline connection.

2. Apparatus according to claim 1 in which said means for applying said compressive force is a jack.

3. Apparatus according to claim 2 in which said means for attaching said A-frame legs to said vehicle fixed structure comprises a bolt passing generally horizontally through aligned holes in said A-frame legs and said fixed structure.

4. Apparatus according to claim 3 in which a safety clip is provided for attaching said A-frame to a mounting hole extant in the cantilvered end of said arm, thereby to prevent excessive undesired movement of said A-frame during application of said compressive force.

5. Apparatus according to claim 2 in which said jack is further defined as a hydraulic jack.

6. Apparatus according to claim 1 in which a safety clip is provided for attaching said A-frame to a mounting hole extant in the cantilevered end of said arm, thereby to prevent excessive undesired movement of said A-frame during application of said compressive force.

7. Apparatus according to claim 2 in which said jack is a hydraulic jack having an upwardly projecting piston rod and an upwardly facing U-shaped piece attached to said piston rod for securely engaging said arm lower edge.

* * * * *